US007431603B1

(12) United States Patent
Szmidt

(10) Patent No.: US 7,431,603 B1
(45) Date of Patent: Oct. 7, 2008

(54) ELECTRICAL WIRE CONNECTOR

(76) Inventor: Ryan Joseph Szmidt, 340 Tortuga Way, Melbourne, FL (US) 32904

( * ) Notice: Subject to any disclaimer, the term of this patent is extended or adjusted under 35 U.S.C. 154(b) by 16 days.

(21) Appl. No.: 11/607,644

(22) Filed: Dec. 1, 2006

(51) Int. Cl.
*H01R 13/28* (2006.01)

(52) U.S. Cl. ..... 439/289; 439/441; 439/701

(58) Field of Classification Search ..... 439/289, 439/441, 700, 843, 851
See application file for complete search history.

(56) References Cited

U.S. PATENT DOCUMENTS

| | | | | |
|---|---|---|---|---|
| 4,416,504 | A | 11/1983 | Sochor | |
| 4,708,417 | A | 11/1987 | Woertz | |
| 5,576,675 | A * | 11/1996 | Oldfield | 333/260 |
| 5,890,925 | A | 4/1999 | Bernardini | |
| 6,065,988 | A * | 5/2000 | Kubota | 439/329 |
| 6,261,120 | B1 | 7/2001 | Beege et al. | |
| 6,336,824 | B1 | 1/2002 | Sorig | |
| 6,398,592 | B1 * | 6/2002 | Mori et al. | 439/700 |
| 6,712,649 | B2 | 3/2004 | Mano et al. | |
| 6,851,967 | B2 | 2/2005 | Miyoshi et al. | |
| 6,966,781 | B1 * | 11/2005 | Bullinger et al. | 439/38 |
| 7,077,709 | B1 * | 7/2006 | Shin-Ting | 439/700 |
| 2004/0157484 | A1 | 8/2004 | Louzon | |
| 2005/0164538 | A1 * | 7/2005 | Tiberghien et al. | 439/289 |

* cited by examiner

*Primary Examiner*—Hien Vu
(74) *Attorney, Agent, or Firm*—Hayworth, Chaney & Thomas, PA; Stepen C. Thomas; Robert A. Lynch

(57) ABSTRACT

An electrical wire connector comprising a connector body; a spring contact having two leaf springs, with each of the leaf springs having a free end resiliently biased to engage the free end of the other leaf spring; a slide release having an approximate T-shape and further having a central axis portion capable of being slidably inserted between the resiliently biased free ends of the leaf springs; and a mateable connector cap. The slide release is manually operable to move the free ends of the spring contact between an engaged configuration and a disengaged configuration. When the free ends of the spring contact are in a disengaged configuration, a conductive wire having a stripped end may be positioned therebetween. Manual operation of the slide release moves free ends of the spring contact into an engaged configuration thereby applying a clamping force to the stripped conductive wire tip positioned therebetween.

19 Claims, 18 Drawing Sheets

ELECTRICAL WIRE CONNECTOR

BACKGROUND

1. Field of the Invention

The present invention is generally related to an electrical wire connector and, more particularly, to an electrical wire connector for connecting a conductor with an electrical spring contact by means of two opposingly biased leaf springs that are operable between a clamping engaged configuration and a disengaged configuration by a manually operable slide release.

2. Background of the Invention

The standard device for connecting wires in a domestic electric power distribution wiring system is the wire nut. Two (or more) conductive wires, each comprising a metal core and an insulating sleeve, are stripped at the ends that are to be connected to expose end segments of the metal core and the exposed end segments are inserted into the wire nut and the wire nut is twisted onto the ends of the wires. In this manner, the stripped end segments of the cores are twisted around each other and held in firm, electrically conductive, contact.

The wire nut is applied by hand, and in a typical installation an electrician might have to apply one hundred or more wire nuts. Application of a wire nut requires a substantial manual effort and the repeated twisting motion involved in applying wire nuts may induce repetitive stress injury. Furthermore, while these connectors do not require elaborate tools to terminate the wires on the connector, the nature of the connector itself does not allow wires to be connected or disconnected with power applied because such connectors expose bare, possibly live wires, when removed.

There are many techniques and means for connecting electrical wires or conductors to various electrical devices. One such means is a spring clamp contact which may be comprised of a spring and a contact member. In such devices, the spring is deflected to allow an electrical wire to be inserted between the deflected spring and the contact member. When the spring is released, it tends to return to its pre-deflection position, thereby trapping and securing the electrical wire against the contact member.

The deflection of the spring in such conductors may be accomplished by a variety of techniques. One technique involves the use of a tool, such as a screwdriver, to deflect the spring and allow insertion of an electrical wire between the deflected spring and a contact member. The spring is then released, thereby securing the electrical wire against the contact member.

However, in these types of connectors, there are one or more intermediate parts positioned between the spring and the tool used to ultimately cause the spring to be deflected. The use of such intermediate part(s) is problematic in that it requires more parts and may increase the cost and time required to manufacture and assemble a connector. Moreover, the use of additional parts may cause problems if the intermediate parts break or do not properly engage the spring when the tool is pressed against the intermediate parts.

Additionally, in using these types of connectors, it is important that the tool used to deflect the spring, for example, a screwdriver, be prevented from slipping off of the spring as the spring is being deflected. If the tool used to deflect the spring slips off of the spring, it may become lodged or trapped between the partially deflected spring and the housing of the connector. Such occurrences can result in damage to the spring, the contact and the housing, either when the tool slips off or when attempts are made to withdraw the trapped tool. If the tool is not prevented from slipping off the spring as it is depressed, workers installing the electrical wires into the connector will have to take other steps to attempt to insure that the tool does not slip off of the spring as it is being deflected. For example, the workers may be able to slightly manipulate the angle of the tool with respect to the spring as the spring is being deflected. Whatever techniques may be employed by workers to attempt to prevent the tool from slipping off the spring, it will likely require more time to install the electrical wires into the conductor than would be required if a spring clamp contact has a mechanism to prevent the tool from slipping off the spring in the first place.

U.S. Pat. App. Pub. 2004/0157484 to Louzon discloses a connector wherein a bracket has opposing first and second electrically conductive portions extending perpendicularly to the insertion passage for an insulated electrical wire.

U.S. Pat. No. 6,074,241 to Patel et al. discloses an electrical connector wherein a free end of a spring is adapted to be directly engaged by a tool inserted into the connector housing to deflect the spring thereby allowing insertion of an electrical wire into the connector adjacent an electrical contact.

U.S. Pat. No. 6,261,120 to Beege et al. discloses a device having a resilient V-shaped electrical contact comprising a support leg mounted generally parallel with and spaced from a bus bar and a clamping leg for biasing an electrical conductor toward lateral electrical engagement with the bus bar.

U.S. Pat. No. 6,280,233 to Beege et al. discloses a resilient clamping member that biases a conductor into electrical engagement with an electrical contact wherein the clamping member has a lateral offset terminal portion and an external release tool is utilized to disengage the clamping edge.

U.S. Pat. No. 6,336,824 to Sorig discloses a screwless junction box or terminal connector including a housing containing a chamber in which are mounted an electrical contact and a clamping spring, the clamping spring being operable to bias a conductor toward electrical engagement with the contact, characterized by the provision of a slide member that is manually operable from a released position toward an inserted position, thereby to displace the clamping leg toward a disengaged position relative to the electrical contact, whereby the conductor may be inserted directly within the housing chamber. A restoring spring biases the slide member toward its released return position.

U.S. Pat. No. 6,851,967 to Miyoshi et al. discloses a wire connector having a manipulation button that when pushed, a manipulation portion of the button pushes down on one side of a leaf spring and the button is capable of being locked into position.

The present invention is directed to a connector that uniquely solves or reduces some or all of the aforementioned problems found within the field of art of electrical wire connectors.

SUMMARY

The present invention is directed to an electrical wire connector having a box-shaped connector body, which has a first end defining a wire aperture through which a conductive wire with a stripped end may be passed and a second end that is disposed opposite the first end. The connector body houses a spring contact having two approximately V-shaped leaf springs, with each of the leaf springs having a free end resiliently biased to engage the free end of the other leaf spring. The resiliently engagable leaf springs are capable of providing a clamping force when a conductive wire is disposed between their free ends. Additionally, the spring contact further has a deflectable tongue extending through the second end of the connector body. The connector body also houses a slide release having an approximate T-shape and further having a central axis portion capable of being slidably inserted between the resiliently biased free ends of the leaf springs. When the central axis portion is so inserted, the free ends of the leaf springs are locked in a disengaged position, allowing a conductive wire to be inserted between the disengaged free ends of the leaf springs. The central axis portion of the slide release further defines a wire passageway along the central axis of the slide release and the wire passageway is aligned with the wire aperture of the connector body. Further, a connector cap is attached to the second end of the connector body.

DETAILED DESCRIPTION

Figure 1:
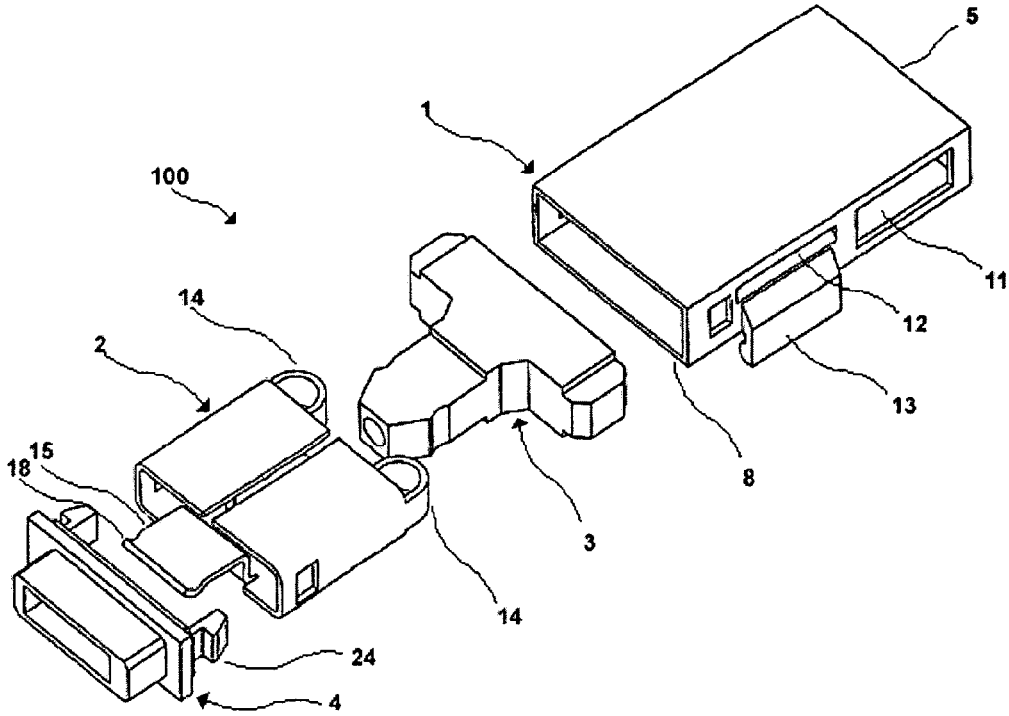
FIG. 1 depicts a perspective view of the components of an embodiment of the present invention.
Figure 2:
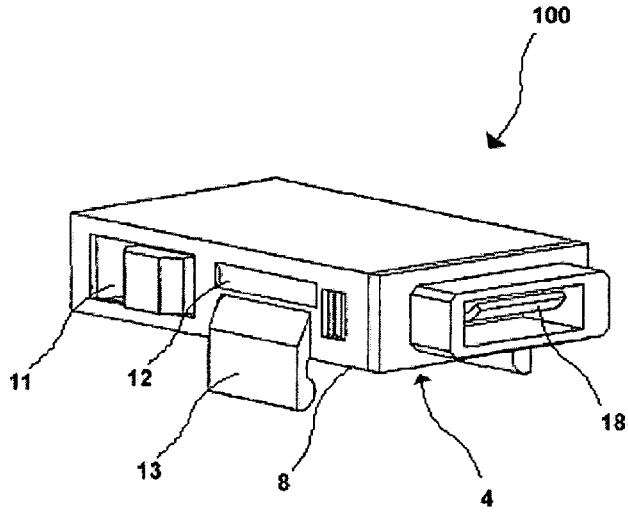
FIG. 2 depicts a perspective view of an embodiment of a male connector unit of the present invention with the free ends of the leaf springs in the disengaged position.
Figure 3:
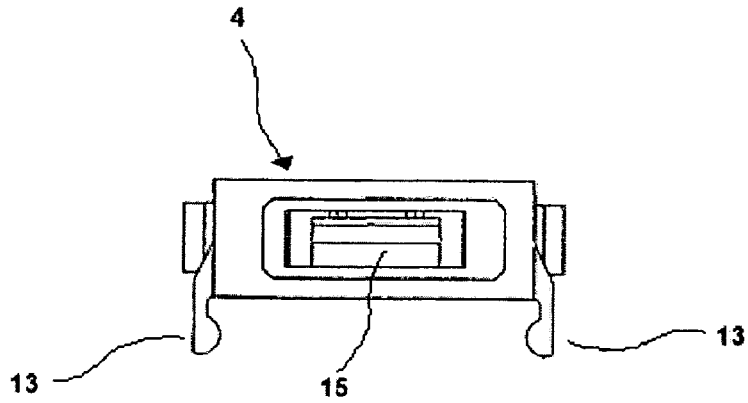
FIG. 3 depicts an end view of the embodiment from FIG. 2.
Figure 4:
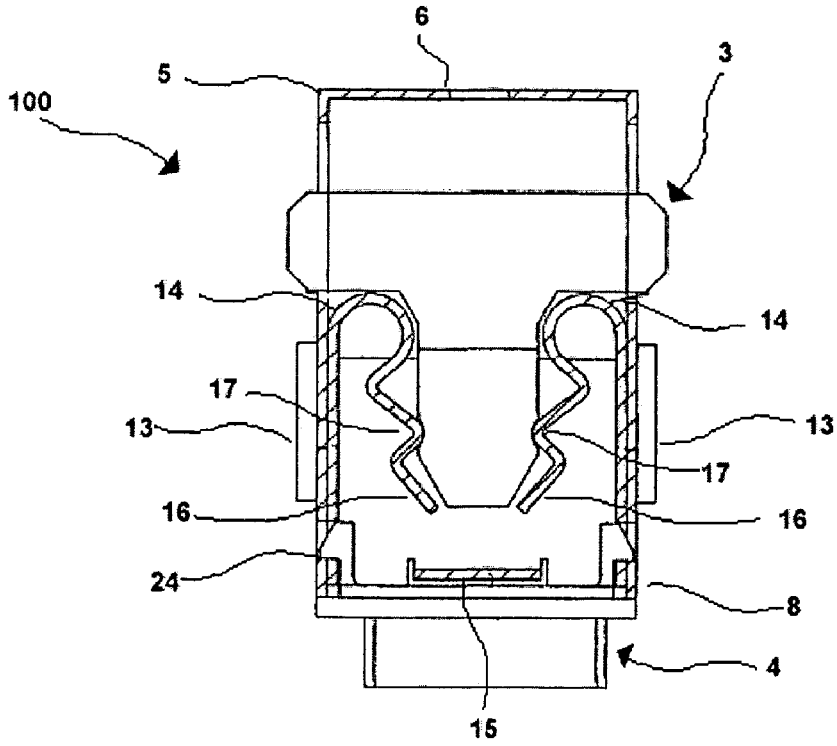
FIG. 4 depicts a top view of the embodiment from FIG. 2.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

In this disclosure, "non-conductive material" refers to any suitable non-conductive material known in the electrical arts. Such non-conductive material may include, but is not limited to, insulating synthetic polymer materials or Delrin®. Delrin® is the brand name for an acetal resin engineering plastic invented and sold by DuPont®. Often marketed and used as a metal substitute, Delrin® is a lightweight, low-friction, and wear-resistant plastic capable of operating in temperatures in excess of 90 degrees Celsius (approximately 200 degrees Fahrenheit). Delrin® is further known as an efficient low friction, non-electrically conductive material. Such a material reduces the frictional forces to allow for easier operation through the application of a lower overall manipulative force. Other names for this compound include: polyoxymethylene, acetal resin, polytrioxane and polyformaldehyde.

In this disclosure, "conductive material" refers to any suitable conductive material known in the electrical wire connector art. Such conductive material may be, but is not limited to, lead-coated copper sheets.

An embodiment of an electrical wire connector 100 of the present invention comprises, as shown in FIG. 1 to FIG. 35, a connector body 1, a spring contact 2, a slide release 3, and a connector cap 4.

Figure 5:
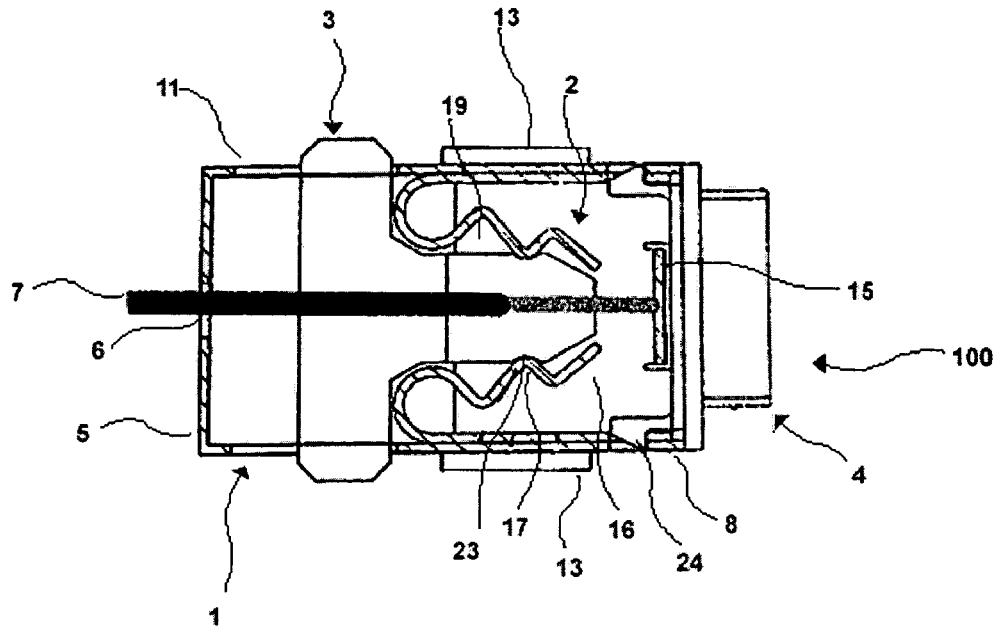
FIG. 5 depicts a top view of the embodiment of FIG. 2 in a disengaged position with a conductive wire having a stripped end inserted into the device.
Figure 6:
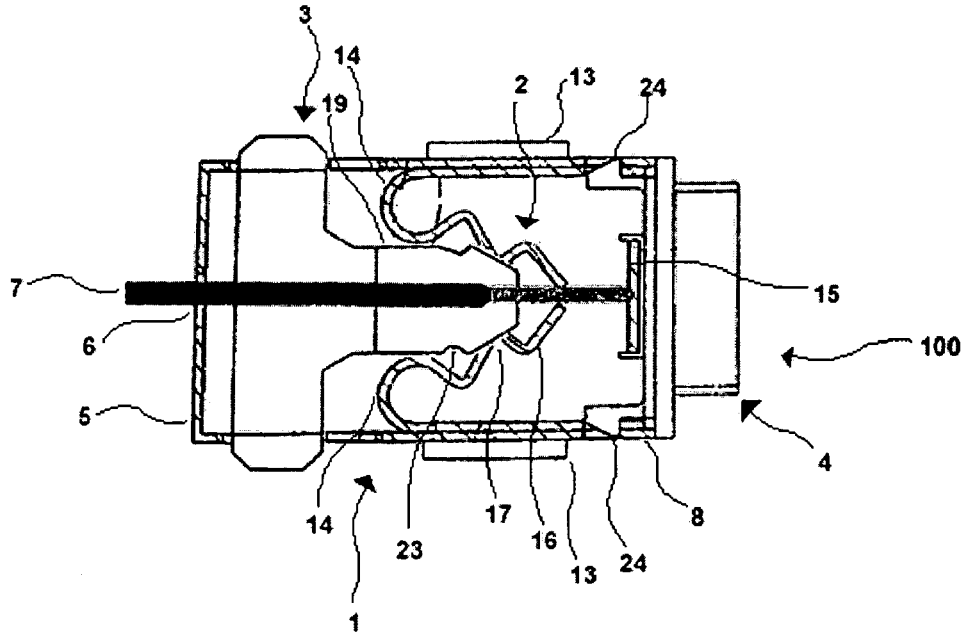
FIG. 6 depicts a top view of the embodiment of FIG. 2 in an engaged position with a conductive wire having a stripped end inserted into the device and the wire being engaged by the biased free ends of the leaf springs of the spring contact.
Figure 7:
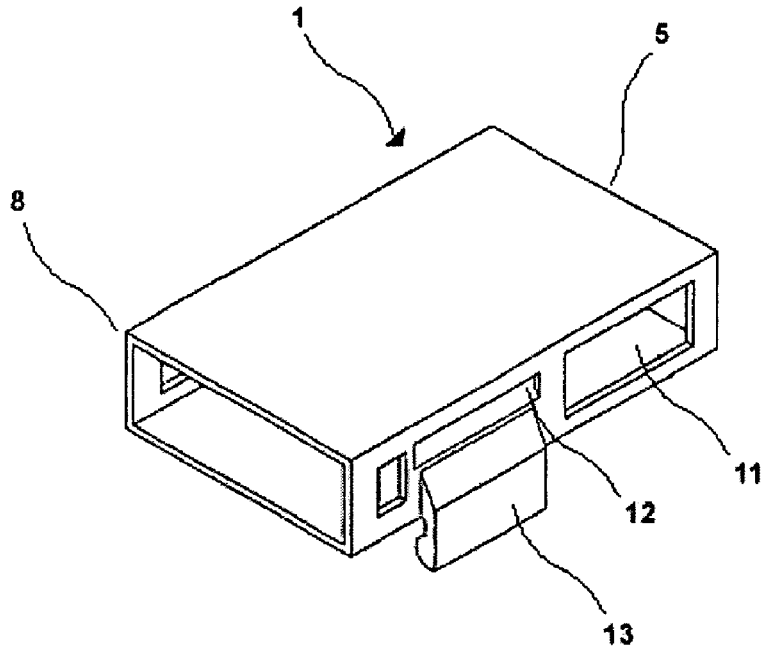
FIG. 7 depicts a perspective view of an embodiment of the connector body of the present invention.
Figure 8:
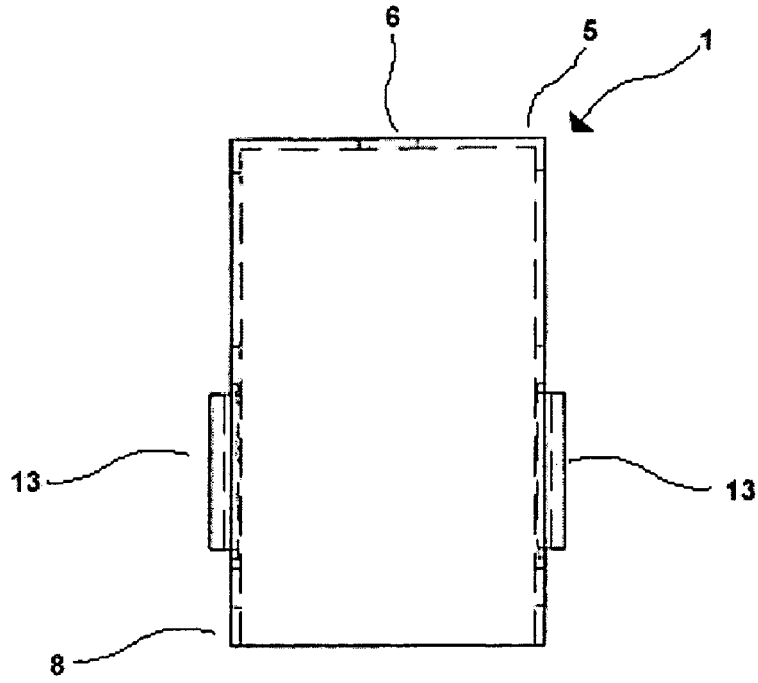
FIG. 8 depicts a top view of the connector body embodiment from FIG. 7.
Figure 9:
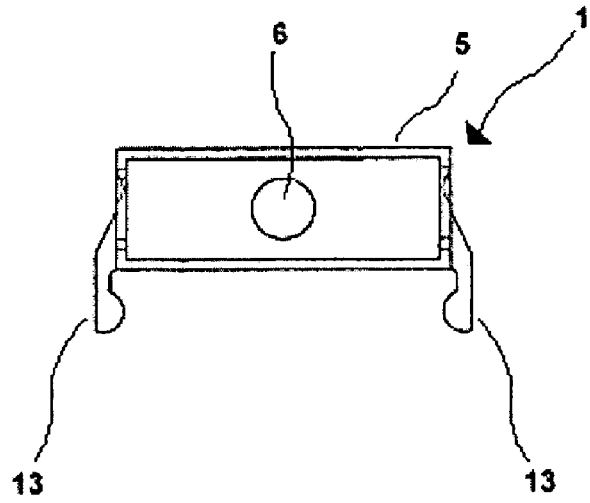
FIG. 9 depicts an end view of the connector body embodiment from FIG. 7.
Figure 10:
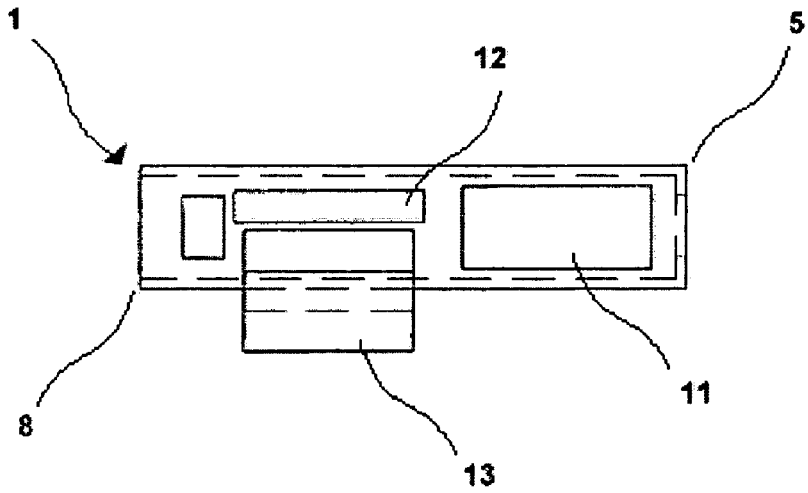
FIG. 10 depicts a side view of the connector body embodiment from FIG. 7.
Figure 11:
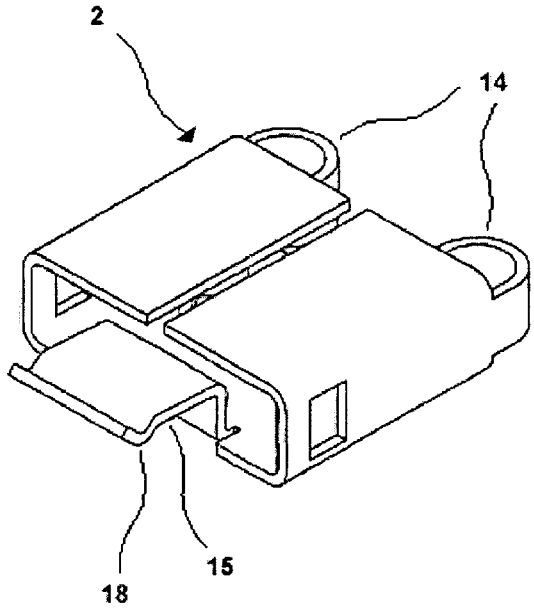
FIG. 11 depicts a perspective view of an embodiment of the spring contact of the present invention.
Figure 12:
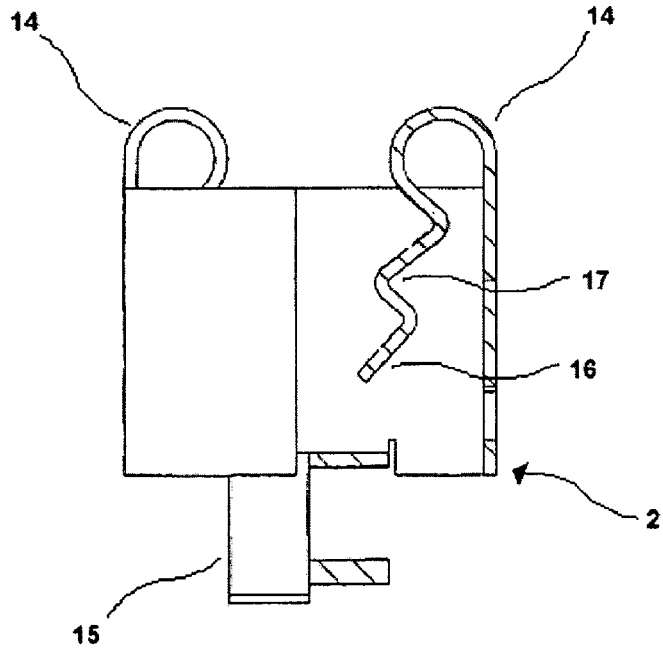
FIG. 12 depicts a top view of the spring contact embodiment from FIG. 11.
Figure 13:
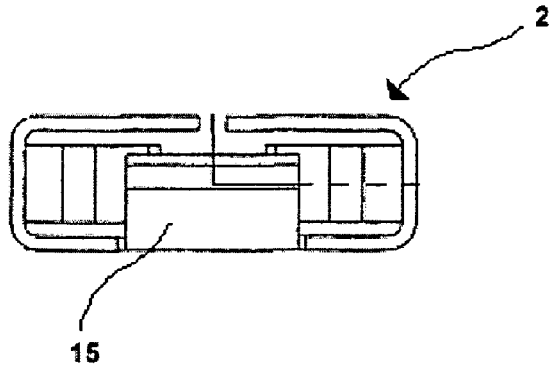
FIG. 13 depicts an end view of the spring contact embodiment from FIG. 11.
Figure 14:
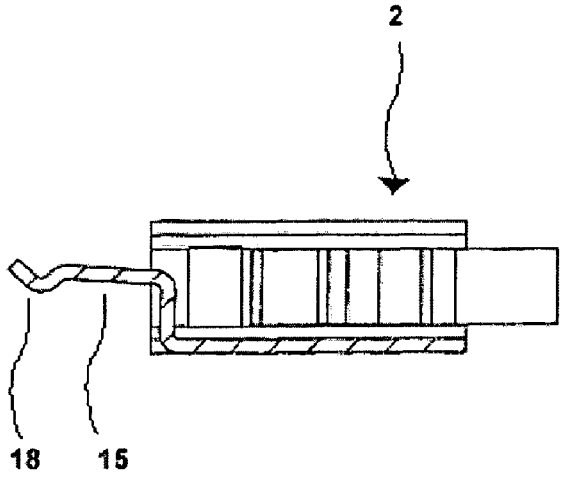
FIG. 14 depicts a side view of the spring contact embodiment from FIG. 11.
Figure 15:
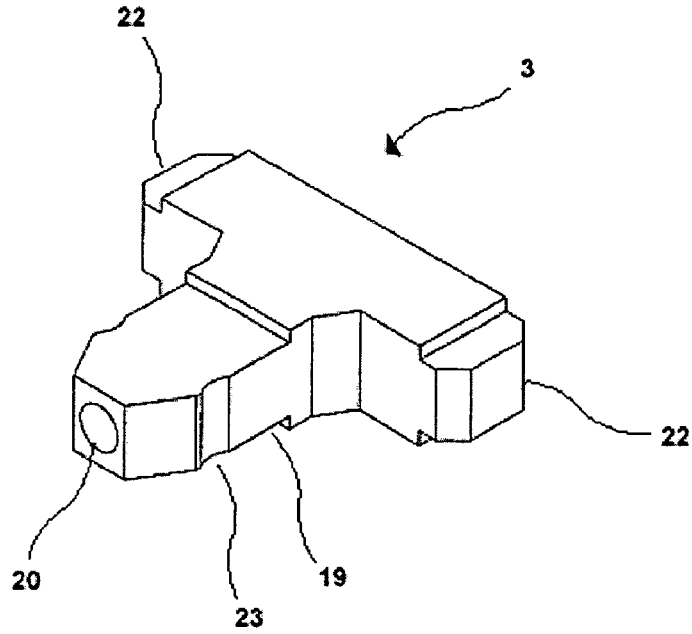
FIG. 15 depicts a perspective view of an embodiment of the slide release of the present invention.

As shown in FIG. 1 to FIG. 10, the connector body 1 may be box-shaped, or cuboid, and is composed of non-conductive material to shield a user from the electrically conductive material housed within the connector body 1. The connector body 1 has a first end 5 that defines a wire aperture 6. Wire aperture 6 is dimensioned to receive a stripped end of an insulated conductive wire 7, as shown in FIGS. 5-6, and wire aperture 6 may be chamfered to reduce damage to the conductive wire 7 tip and further facilitate insertion of wire 7 into the wire aperture 6. Connector body 1 serves as an insulating shell housing spring contact 2 and slide release 3. A second end 8 of the connector body 1, disposed opposite the first end 5, forms an attachment point for connector cap 4. Two opposing side walls 9,10 on the connector body 1 each define a slide aperture 11 and a latch indentation 12, while also having a deflectable latch attachment 13 disposed thereon. The slide apertures 11 enable a user to slidably manipulate slide release 3 while slide release 3 is housed within connector body 1. Latch indentations 12 and deflectable latch attachments 13 cooperatively allow for "stacking" of two or more electrical wire connectors 100 by means of complimentary attachments between their respective connector bodies 1. FIG. 30 to FIG. 35 depicts the stacking capability contemplated by the latch indentations 12 and deflectable latch attachments 13 of the present invention. Latch indentations 12 may be constructed in several forms including, but not limited to, indentations, grooves, or holes that may project through the connector body 1 wall.

As shown in FIG. 1, FIGS. 4-6 and FIGS. 11-14, spring contact 2 is housed within connector body 1 and composed of a conductive material. Spring contact 2 comprises two leaf springs 14 and a deflectable tongue 15. Leaf springs 14 are generally V-shaped, each having a resilient arm having a free end 16 resiliently biased toward the free end 16 of the other opposed leaf spring 14 along the central axis of the spring contact 2. FIG. 6 depicts the general bias of the resilient arm free ends 16 of the leaf spring 14 towards each other. Such a bias creates a clamping pressure on any item placed between the free ends 16, such as the stripped end of the conductive wire 7. Such a clamping pressure is sufficient to prevent the undesired removal of the conductive wire 7 from the electrical wire connector 100 under normal operating conditions. The insertion and/or removal of conductive wire 7 between the free ends 16 of the leaf springs 14 is facilitated by the function of the slide release 3, discussed below. A protuberance 17 is further disposed on the resilient arm of each of the leaf springs 14. Protuberance 17 may be constructed by any means, such as a bend in the free arm material or a localized thickening of the free arm material. Deflectable tongue 15 projects through the second end 8 of the connector body 1. Deflectable tongue 15 may be configured in an approximately L-shaped form having an offset distal tip 18. Offset distal tip 18 of the deflectable tongue 15 deflects against and forms an electrically conductive connection with a deflectable tongue having a complimentary offset distal tip on a second electrical wire connector, as depicted in FIG. 29.

Figure 16:
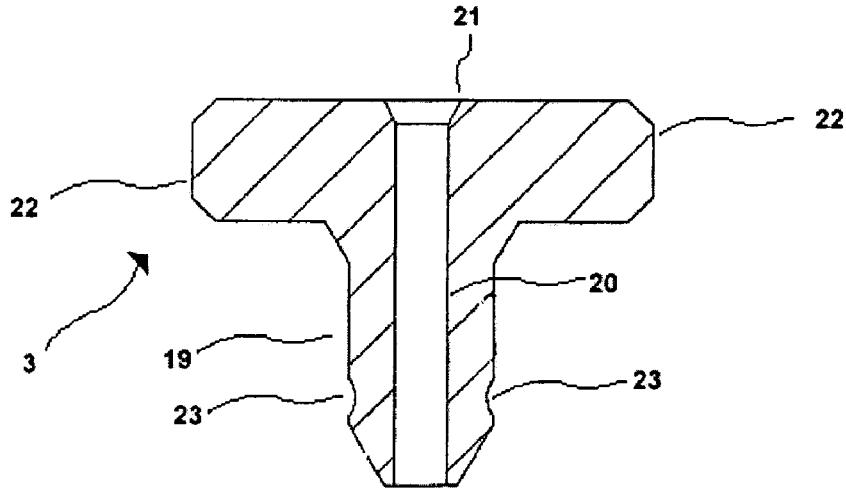
FIG. 16 depicts a top view of the slide release embodiment from FIG. 15.
Figure 17:
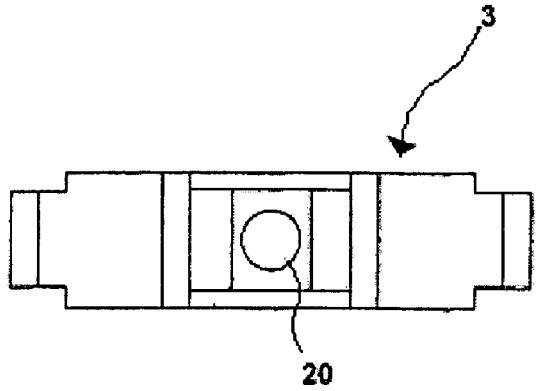
FIG. 17 depicts an end view of the slide release embodiment from FIG. 15.
Figure 18:
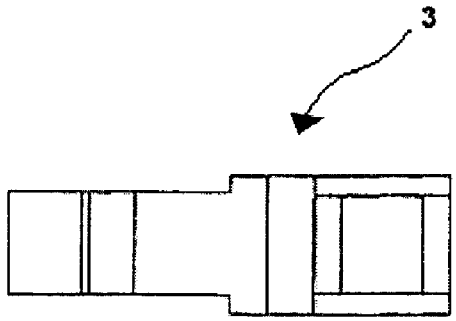
FIG. 18 depicts a side view of the slide release embodiment from FIG. 15.
Figure 19:
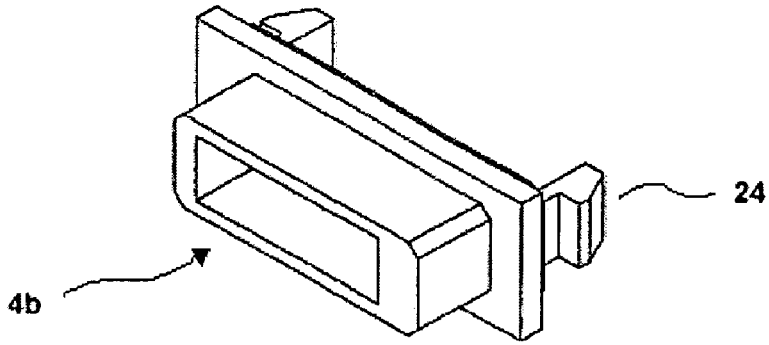
FIG. 19 depicts a perspective view of an embodiment of the male connector cap of the present invention.
Figure 20:
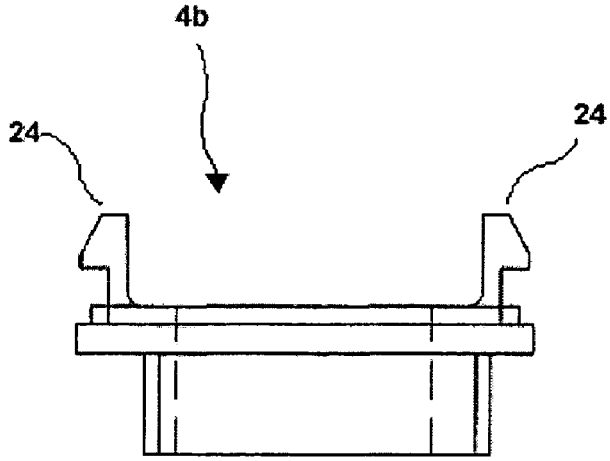
FIG. 20 depicts a top view of the male connector cap embodiment from FIG. 19.
Figure 21:
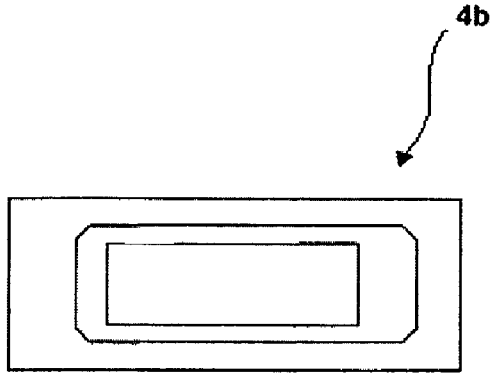
FIG. 21 depicts an end view of the male connector cap embodiment from FIG. 19.
Figure 22:
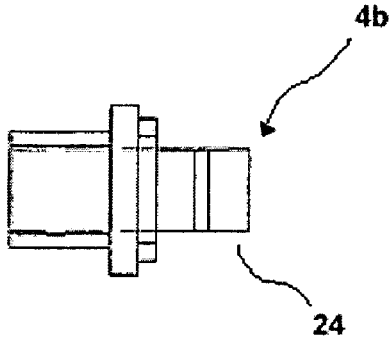
FIG. 22 depicts a side view of the male connector cap embodiment from FIG. 19.
Figure 23:
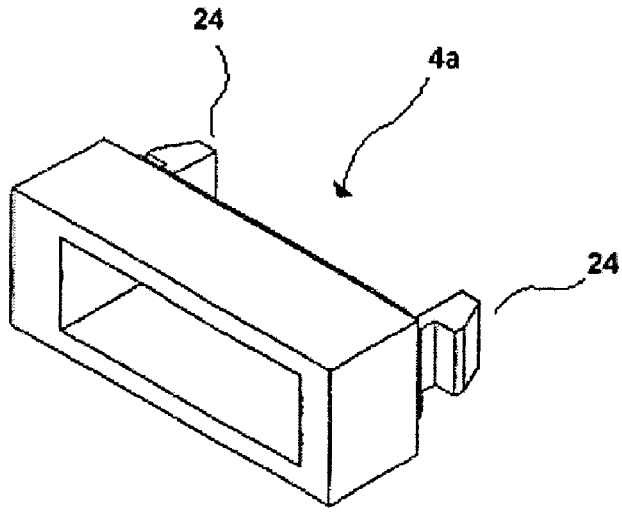
FIG. 23 depicts a perspective view of an embodiment of the female connector cap of the present invention.
Figure 24:
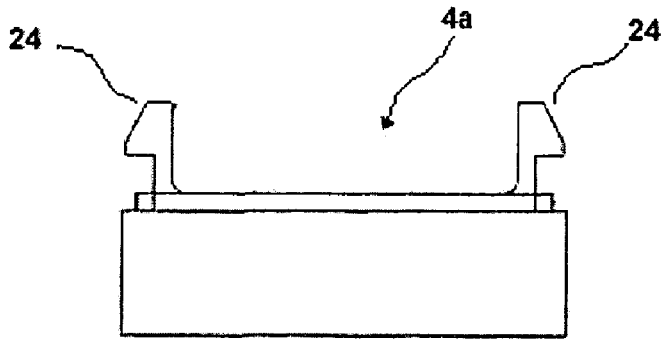
FIG. 24 depicts a top view of the female connector cap embodiment from FIG. 23.
Figure 25:
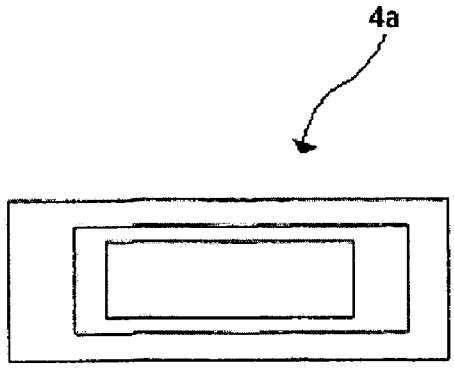
FIG. 25 depicts an end view of the female connector cap embodiment from FIG. 23.
Figure 26:
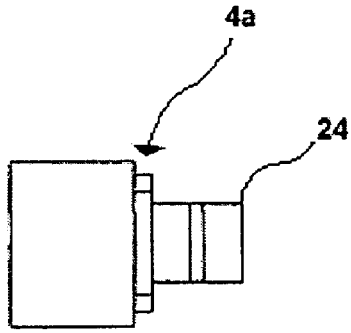
FIG. 26 depicts a side view of the female connector cap embodiment from FIG. 23.

As shown in FIG. 1, FIGS. 4-6, and FIGS. 15-18, slide release 3 is housed within the connector body 1 and composed of non-conductive material. Slide release 3 may be formed in an approximately T-shaped configuration. The central axis portion 19 of the slide release 3 further defines a cylindrical wire passageway 20 along the central axis of the slide release 3. Wire passageway 20 is in alignment with the wire aperture 6 of the first end 5 of the connector body 1. A conductive wire inserted through the wire aperture 6 subsequently enters the wire passageway 20. Damage to multi-wire conductors or fine-wire conductors may be greatly reduced by chamfering the leading edges of either, or both, the wire aperture 6 and the wire passageway 20. FIG. 16 depicts a chamfered leading edge 21 of the wire passageway 20 defined by the slide release 3. The two top ends 22 of the slide release 3 project through the connector body 1 via the slide apertures 11 defined by the opposing side walls 9,10 of the connector body 1. The two top ends 22 exit connector body 1 at slide apertures 11 and allow manual user manipulation of the slide release 3 while housed within connector body 1. FIG. 5 depicts slide release 3 in a forward position, wherein the central axis portion 19 of slide release 3 is slidably disposed between the free ends 16 of the arms of leaf springs 14. Free ends 16 are disengaged from each other while slide release 3 is in such a forward position, allowing for insertion therein of a stripped end of the conductive wire 7. After manual user manipulation of the two top ends 22 of slide release 3, FIG. 6 depicts the slide release 3 in a back position, wherein the central axis portion 19 of slide release 3 is slidable retracted from its prior position between free ends 16 of the arms of leaf springs 14. When in the back position, retraction of the slide release 3 allows the biased free ends 16 of the leaf springs 14 to re-engage and come together to exert a clamping force there between. A conductive wire 7 end fully inserted in wire passageway 20 while the slide release 3 was in a forward position (FIG. 5) becomes held in place by the biased clamping force exerted by the free ends 16 of the leaf springs 14 upon retraction of the slide release 3 into the back position (FIG. 6). To further assist in the installation of the wire connector of the present invention, the central axis portion 19 of the slide release 3 may incorporate indentations 23 complimentary to the protuberances 17 on the resilient arms of the leaf springs 14. Slide release 3 may therefore be held in its forward position, disengaging the free ends 16 of the leaf springs 14, by the mating of protuberances 17 on leaf springs 14 into the complimentary indentation 23 on the central axis portion 19 of the slide release 3, as depicted in FIG. 5. Manual user retraction of top ends 22 of slide release 3, relative to connector body 1, allows an efficient means to disengage protuberances 17 from indentations 23. FIG. 6 depicts the result of the retraction of slide release 3, and the return to the original biased position of free ends 16 of leaf springs 14.

Figure 27:
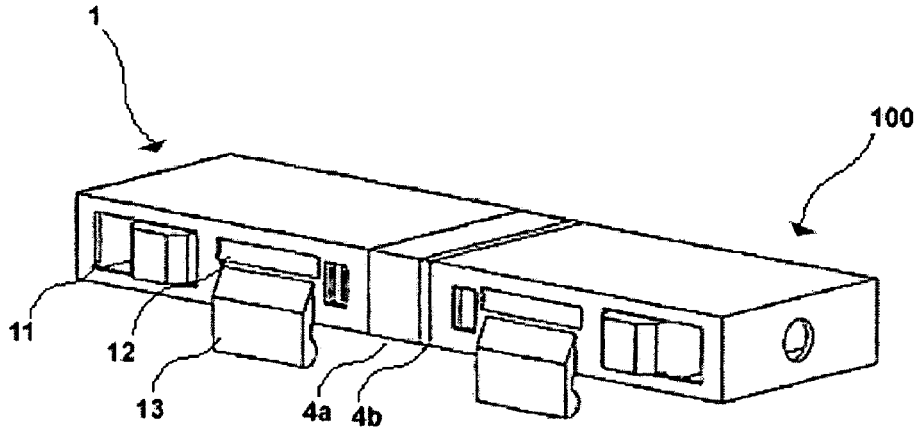
FIG. 27 depicts a perspective view of a male-capped connector unit mateably connected to a second female-capped connector unit of the present invention.
Figure 28:
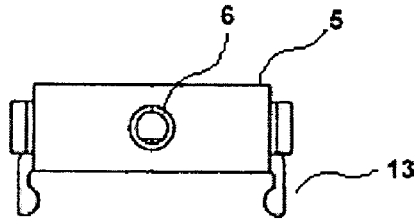
FIG. 28 depicts an end view of the mateably connected male-capped connector unit and female-capped connector unit from FIG. 27.
Figure 29:
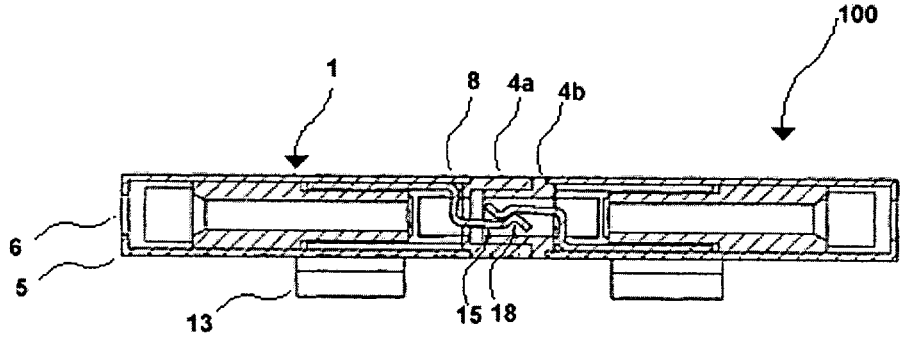
FIG. 29 depicts a side view of the mateably connected male-capped connector unit and female-capped connector unit from FIG. 27.
Figure 30:
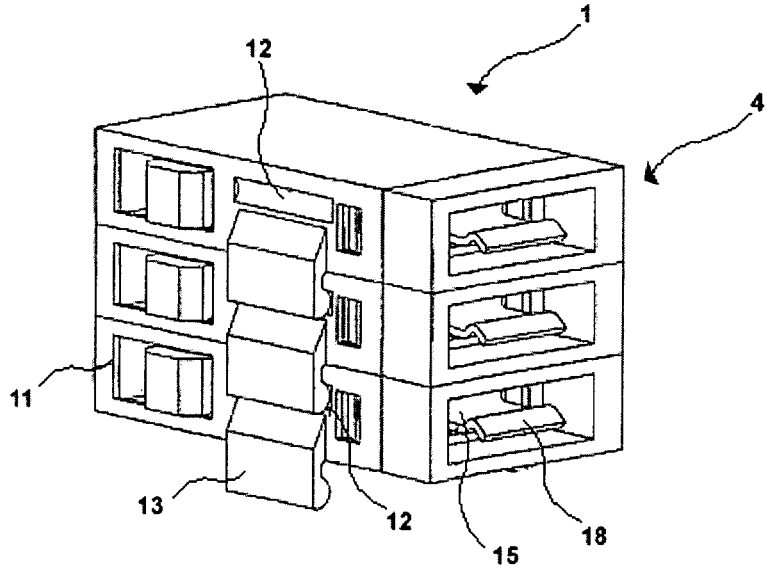
FIG. 30 depicts a perspective view of three female-capped connector units in a stacked configuration.
Figure 31:
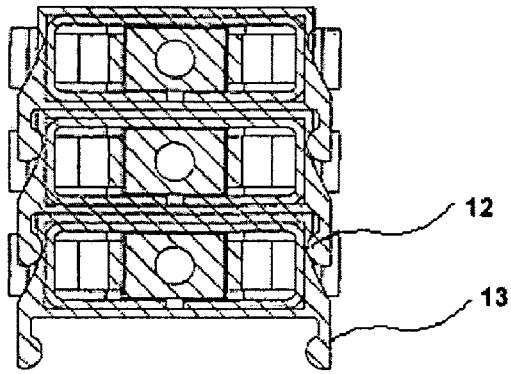
FIG. 31 depicts an end view of the three female-capped connector units in a stacked configuration from FIG. 30.
Figure 32:
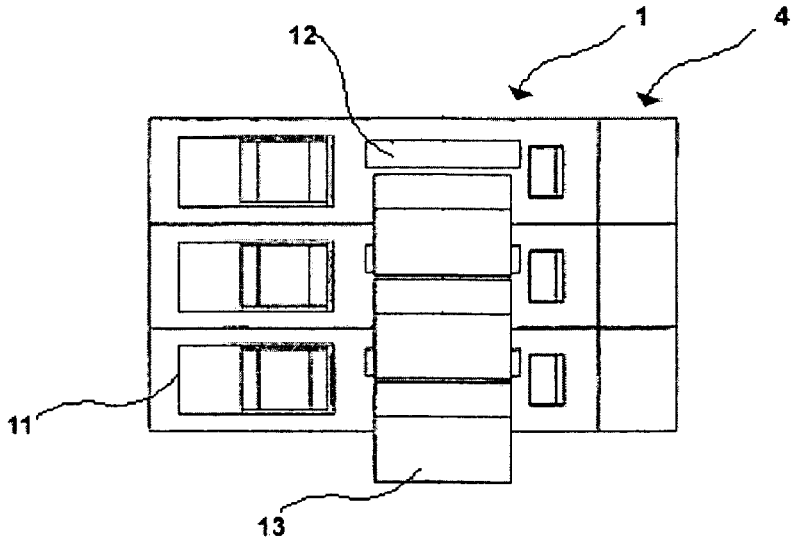
FIG. 32 depicts a side view of the three female-capped connector units in a stacked configuration from FIG. 30.
Figure 33:
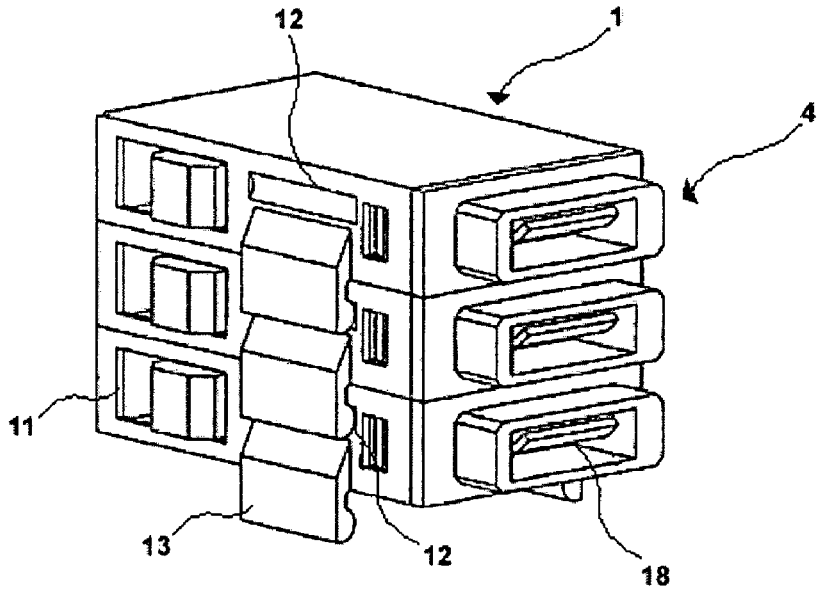
FIG. 33 depicts a perspective view of three male-capped connector units in a stacked configuration.
Figure 34:
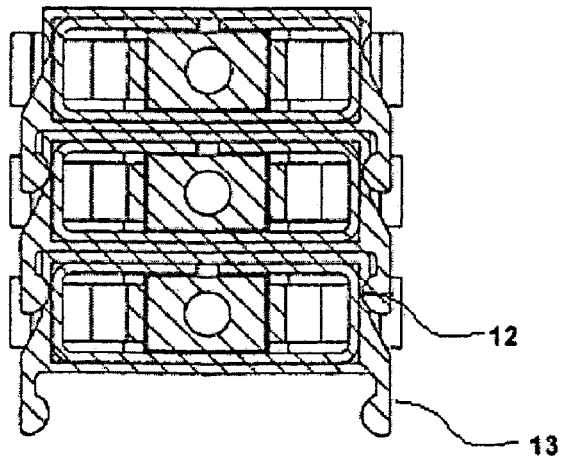
FIG. 34 depicts an end view of the three male-capped connector units in a stacked configuration from FIG. 33.
Figure 35:
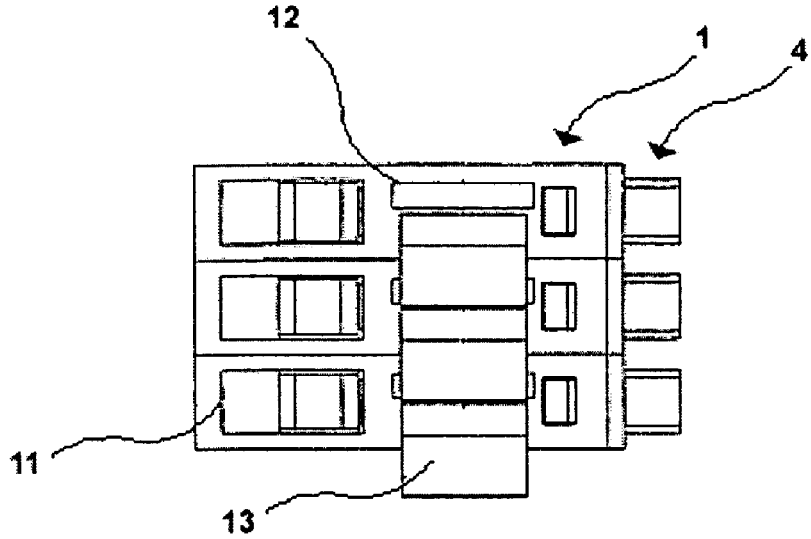
FIG. 35 depicts a side view of the three male-capped connector units in a stacked configuration from FIG. 33.

As shown in FIGS. 1-6, FIG. 27, FIG. 29, FIG. 30 and FIG. 33, connector cap 4 is attached to the second end 8 of connector body 1. Connector cap 4 serves to allow the connection of two separate electrical wire connectors 100. Connector caps 4 are formed in complimentary configurations, such as male forms **4*b* depicted in FIGS. 19-22, and their complimentary female forms 4*a* depicted in FIGS. 23-26. With one electrical wire connector having a male connector cap 4*b* and a separate electrical wire connector having a female connector cap 4*a*, the two electrical wire connectors may then be connected via a complimentary connection of the respective male 4*b* and female 4*a* connector caps, as depicted in FIG. 27 and FIG. 29. When such a complimentary connection of connector caps occurs, the offset terminal ends 18 of the deflectable tongues 15 of the electrical wire connectors 100 contact each other to form an electrically conductive connection. Connector cap 4 may be attached to the second end 8 of connector body 1 by means of hooks or latch attachments. FIG. 1 and FIGS. 4-6, depict a latch attachment 24 for securing male connector cap 4 to the second end of connector body 1**.

In use, as depicted in FIG. 5, an insulated conductive wire 7 having a stripped end is inserted into the wire aperture 6 of the first end 5 of the connector body 1. Conductive wire 7 subsequently passes through the wire passageway 20 of slide release 3. With the slide release 3 in the forward position, the central axis portion 19 of slide release 3 is slidably disposed between the free ends 16 of the arms of leaf springs 14. Free ends 16 are disengaged from each other while slide release 3 is in such a forward position, allowing for insertion therein of conductive wire 7. Further, slide release 3 locks free ends 16 in the disengaged position when protuberances 19 of spring contact 2 matingly couple with the indentations 23 on the central axis portion 19 of slide release 3. With free ends 15 held in the disengaged position, the tip of conductive wire 7 is able to pass there between free ends 16 and proceed until conductive wire 7 contacts the L-shaped deflectable tongue 15 of spring contact 2.

With the stripped tip of conductive wire 7 contacting deflectable tongue 15, FIG. 6 depicts the fastening of the electrical wire connector 100 to conductive wire 7. With the conductive wire 7 positioned as described above, the user then may then manipulate the top ends 22 of slide release 3 to retract the central axis portion 19 of the slide release 3 from between the free ends 16 of the spring contact 2. Top ends 22 project through and are slidingly engaged within slide apertures 11 of the connector body 1. As slide release 3 is retracted, free ends 16 of the leaf springs 14 of spring contact 2 return to their original biased position along the central axis of the device, thus providing a clamping force on the stripped tip of conductive wire 7 now located there between. The clamping force generated is sufficient to prevent unwanted retraction of the conductive wire 7 from the electrical wire connector 100. Furthermore, the clamping contact between the stripped end of conductive wire 7 and the biased free ends 16 of the leaf springs 14 serve to create an electrically conductive connection passing an electrical current from the tip of the conductive wire 7 to the free ends 16 of the leaf springs of the spring contact 2. With all portions of the spring contact 2 being composed entirely of conductive material, an electrical current applied to the free ends 16 of the leaf springs 14 of the spring contact 2 is transmitted to the deflectable tongue 15 portion of the spring contact 2.

FIG. 27 and FIG. 29 depict the completion of an electrically conductive connection established between two separate electrical wire connectors. Each electrical wire connector depicted is attached to an end of a conductive wire 7 as disclosed above. Complimentary connector caps 4*a* and 4*b* are disposed on the second ends 8 of the respective connector bodies 1. The male 4*b* and female 4*a* complimentary connector caps provide a mateable connection between the two separate electrical wire connectors. When the mateable connector caps 4 make their connection, the deflectable tongues 15 of the separate electrical wire connectors also come together. The offset distal tips 18 of the deflectable tongues 15 deflect against one another and form an electrically conductive connection between the two separate electrical wire connectors. To facilitate such an electrically conductive connection, the deflectable tongues 15 have complimentary offset distal tips 18, as depicted in FIG. 29.

FIGS. 30-35 depict the ease of creating multiple electrically conductive connections. Utilizing the latch indentations 12 and the deflectable latch attachments 13 incorporated on each connector body 1, multiple connector bodies 1 of multiple electrical wire connectors may be arranged in a stacked configuration to conserve workspace and provide free access to a great number of electrically conductive wire connections.

The present invention provides a quick and efficient means of establishing electrical connections within mateable electrical wire connectors. The present invention allows a user, preferably an electrician, to create an electrical connection between two wire ends by manually attaching complimentary wire connectors to each wire end. The electrical wire connector of the present invention is both quickly and easily installed on and/or removed from exposed wire ends. Having two complimentarily-capped electrical wire connectors installed allows the creation of and/or severance of an electrical connection while power to the wire ends is maintained due to the protective non-conductive shielding provided by the connector body 1. Additionally, the present invention may be used with a solid wire or stranded wire conductor.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An electrical wire connector comprising:

a connector body comprising a first end defining a wire aperture through which a conductive wire having a stripped end may be passed and a second end disposed opposite said first end;

a spring contact housed within said connector body comprising two approximately V-shaped leaf springs, each of said leaf springs having a free end, the free end of one of the leaf springs being resiliently biased to engage said free end of said other leaf spring and capable of providing a clamping force on said strip end of said conductive wire when said conductive wire is disposed between said free ends;

a slide release housed within said connector body, said slide release having an approximate T-shape and further having an elongated central axis portion capable of being slidably inserted between said resiliently biased free ends of said leaf springs for maintaining said free ends in a disengaged position, said central axis portion further defining a wire passageway along the central axis of said slide release and said wire passageway being in alignment with said wire aperture of said connector body; and a connector cap attached to said second end of said connector body;

wherein said spring contact further comprises a deflectable L-shape tongue extending through and outwardly from said second end of said connector body.

2. The electrical wire connector of claim 1, where said connector body, said slide release, and said connector cap are composed of non-conductive material.

3. The electrical wire connector of claim 2, wherein said connector body has a slide aperture on each of two opposing side walls through which top ends of said T-shaped slide release project, said slide apertures allowing slidable manipulation of said slide release within said connector body.

4. The electrical wire connector of claim 3, wherein said resilient free arms of said leaf springs further comprise a protuberance along the length of each of said resilient arms and said central axis portion of said slide release further comprises indentations complementary to and capable of receiving said protuberances of said leaf spring resilient free arms for securing said leaf spring resilient free arms in a disengaged configuration.

5. The electrical wire connector of claim 4, wherein said connector cap takes the form of a male or female connector cap for providing a mateable connection with a second electrical wire connector having a complimentary connector cap.

6. The electrical wire connector of claim 1, wherein said deflectable tongue of said spring contact is L-shaped and further comprises an offset terminal portion for creating a conductive connection with a deflectable tongue of said second electrical wire connector having said complimentary connector cap.

7. The electrical wire connector of claim 6, wherein said connector body has a deflectable latch attachment and a latch indentation on each of said two opposing side walls, wherein said deflectable latch attachment on said connector body enables said connector body to be stacked and attached to a connector body of a separate electrical wire connector by means of a complimentary connection formed between said deflectable latch attachment on said connector body and said latch indentation on a connector body of said separate electrical wire connector.

8. The electrical wire connector of claim 7, where said non-conductive material is polyoxymethylene.

9. An electrical wire connector in which by manually manipulating a slide release composed of non-conductive material and having a T-shape configuration housed within a connector body composed of non-conductive material, a central axis portion defining a central wire passage of said slide release is slidably inserted between the free ends of two resiliently deformable opposing leaf springs that are part of a spring contact composed of conductive material, said spring contact being housed within said connector body, a first end of said connector body defining a wire aperture for insertion of a wire having a stripped end, said wire then extending into said central wire passage, an opposed open second end of said connector body encircles a deflectable tongue of said spring contact, said open second of said connector body further being attached to a connector cap composed of non-conductive material and further encircling said deflectable tongue of said spring contact wherein said connector cap is capable of forming a complimentary mateable connection with a connector cap of a second electrical wire connector.

10. The electrical wire connector of claim 9, wherein said central axis portion of said slide release comprises opposed indentations capable of receiving complimentary protrusions disposed on each of said leaf spring arms wherein said leaf spring arms are capable of being held in a disengaged configuration but also capable of resilient re-engagement upon the slidable retraction of said slide release.

11. The electrical wire connector of claim 10, wherein connector body has a slide aperture on each of two opposing side walls through which top ends of said T-shaped slide release extend, said slide apertures allowing slidable manipulation of said slide release within said connector body.

12. The electrical wire connector of claim 11, wherein said connector cap takes the form of a male or female connector cap for creating a complimentary mateable connection with said connector cap of said second electrical wire connector.

13. The electrical wire connector of claim 12, wherein said deflectable tongue comprises an offset terminal portion capable of complimentary engagement with a deflectable tongue of said second electrical wire connector.

14. The electrical wire connector of claim 13, wherein said connector body has a deflectable latch attachment and a latch indentation on each of said two opposing side walls, wherein said deflectable latch attachment on said connector body enables said connector body to be stacked and attached to a connector body of a separate electrical wire connector by means of a complimentary connection formed between said deflectable latch attachment on said connector body and said latch indentation on a connector body of said separate electrical wire connector.

15. The electrical wire connector of claim 14, wherein said non-conductive material is polyoxymethylene.

16. An electrical wire connector, comprising:

a connector body composed of non-conductive material having a first end defining a wire aperture through which a conducting wire with a stripped end may be passed and a second end disposed opposite said first end, wherein said connector body has a slide aperture, a deflectable latch attachment and a latch indentation on each of two opposing side walls;

a spring contact composed of conductive material housed within said connector body, said spring contact comprising a first resilient leaf spring and an opposed second resilient leaf spring, said leaf springs, respectively, each being in an approximate V-shape configuration and a free end of a resilient arm of said first leaf spring being biased against a free end of a resilient arm of said second leaf spring for providing a clamping force therebetween when an exposed portion of a conductive wire is positioned between said first ends of said resilient arms of said leaf springs, said resilient arms of said leaf springs further comprising a protuberance along the length of said resilient arms, said spring contact further comprising a deflectable tongue extending in an L-shape from said spring contact with said deflectable tongue having an offset terminal portion;

a slide release composed of non-conductive material in a T-shape configuration housed within said connector body, said slide release having a central axis portion defining a cylindrical wire passageway along its central axis, wherein the central axis portion of said slide release is further capable of slidable manipulation into a position between said first ends of said leaf spring resilient arms of said spring contact and said central axis portion of said slide release further comprising indentations complementary to and capable of receiving said protuberances of said leaf spring resilient arms for securing said resilient arms in a disengaged configuration, and two top ends of said T-shaped slide release extending through said slide apertures of each of said two opposing side walls of said connector body providing slidable manipulation of said slide release within said connector body; and a connector cap composed of non-conductive material attached to said second end of said connector body wherein said connector cap is capable of forming a complementary mateable connection with a connector cap of a second electrical wire connector, said connector cap encircles said offset terminal portion of said deflectable tongue of said spring contact enabling said deflectable tongue to make a complimentary connection with a second offset terminal portion of a deflectable tongue on said second electrical wire connector, wherein said offset terminal portions engage forming an electrically conductive connection.

17. The electrical wire connector of claim 16, wherein said connector cap is of a male form and said connector cap of said second electrical wire connector is of a complementary female form, providing for a secure mateable connection between said electrical wire connectors.

18. The electrical wire connector of claim 17, wherein said deflectable latch attachment on said connector body enables said connector body to be stacked and attached to a connector body of a separate electrical wire connector by means of a complimentary connection formed between said deflectable latch attachment on said connector body and a latch indentation on said connector body of a separate electrical wire connector.

19. The electrical wire connector of claim 18, wherein said non-conductive material is polyoxymethylene.

* * * * *